US007021253B2

(12) United States Patent
Amend et al.

(10) Patent No.: US 7,021,253 B2
(45) Date of Patent: Apr. 4, 2006

(54) TWO-CYCLE ENGINE

(75) Inventors: Helmar Amend, Waiblingen (DE); Klaus-Martin Uhl, Baltmannsweiler (DE)

(73) Assignee: Andreas Stihl AG & Co. KG (DE)

( * ) Notice: Subject to any disclaimer, the term of this patent is extended or adjusted under 35 U.S.C. 154(b) by 145 days.

(21) Appl. No.: 10/799,165

(22) Filed: Mar. 12, 2004

(65) Prior Publication Data

US 2004/0182338 A1 Sep. 23, 2004

(30) Foreign Application Priority Data

Mar. 19, 2003 (DE) ..... 103 12 096

(51) Int. Cl.
*F02B 33/04* (2006.01)

(52) U.S. Cl. ..... 123/73 PP; 123/195 C

(58) Field of Classification Search ..... 123/73 PP, 123/195 C

See application file for complete search history.

(56) References Cited

U.S. PATENT DOCUMENTS 4,712,520 A * 12/1987 Pasquin ..... 123/73 S
2003/0111027 A1 * 6/2003 Schmidt et al. ..... 123/73 PP
2003/0217710 A1 * 11/2003 Geyer et al. ..... 123/73 PP
2004/0182338 A1 * 9/2004 Amend et al. ..... 123/73 PP
2004/0182339 A1 * 9/2004 Geyer et al. ..... 123/73 PP

FOREIGN PATENT DOCUMENTS

DE 26 24 249 12/1976
WO WO 00/43660 7/2000

* cited by examiner

*Primary Examiner*—John T. Kwon
(74) *Attorney, Agent, or Firm*—Robert W. Becker & Associates; Robert W. Becker

(57) ABSTRACT

A two-cycle engine is provided and includes a cylinder in which is formed a combustion chamber delimited by a reciprocating piston that via a connecting rod drives a crankshaft rotatably mounted in a crankcase that, in predetermined positions of the piston, communicates with the combustion chamber via transfer channels. The cylinder has an outlet from the combustion chamber. An intake duct leads into the crankcase for a supply of fuel, and an air duct supplies substantially fuel-free air. In the vicinity of the piston the air duct is divided into two branches that open out at air openings of a connecting flange formed on the cylinder. A cover is disposed on the connecting flange and extends over the air openings. A flow divider on the connecting flange projects beyond a plane thereof and into the cover. The flow divider divides an air flow in the air duct to the two branches.

15 Claims, 4 Drawing Sheets

TWO-CYCLE ENGINE

BACKGROUND OF THE INVENTION

The invention relates to a two-cycle engine, in particular for a manually operated tool such as a chain saw, a parting-off grinder or similar device.

A two-cycle engine in which the air duct is divided into two branches in the area of the cylinder is known from WO 00/43660. Both branches of the air duct run into a common connecting flange. The air duct is divided into the two branches by a dividing wall after the connecting flange in the direction of flow. In this arrangement, the two branches of the air duct extend away from each other when seen from the connecting flange. The course of the branches of the air duct means that the cylinder cannot be manufactured simply by means of diecasting.

The object of the invention is to design a two-cycle engine of the aforementioned general type which can be manufactured simply by means of diecasting and which is small in size.

SUMMARY OF THE INVENTION

This object is achieved by means of a two-cycle engine having a cylinder in which is formed a combustion chamber that is delimited by a reciprocating piston that via a connecting rod drives a crankshaft rotatably mounted in a crankcase, wherein in a predetermined position of the piston, the crankcase communicates with the combustion chamber via transfer channels, wherein the cylinder has an outlet leading out of the combustion chamber, wherein an intake duct leads into the crankcase for the supply of fuel, wherein an air duct is provided for the supply of substantially fuel-free air, and wherein the air duct, in the vicinity of the cylinder, is divided into two branches; the connecting flange is formed on the cylinder, wherein the two branches of the air duct open out at air openings of the connecting flange; a cover is disposed on the connecting flange and extends over the air openings; and a flow divider is disposed or formed on the connecting flange, wherein the flow divider projects beyond a plane of the connecting flange and into the cover, and wherein the flow divider divides an air flow in the air duct to the two branches thereof.

In the design disclosed in the invention the air duct is divided into the two branches in the cover. In this arrangement, the positioning of the flow divider at the connecting flange guarantees that the cover too can be manufactured by means of diecasting without the need for costly slides. Due to the division of the air duct into the two branches in the cover, the air openings can be positioned anywhere and can therefore be positioned at the connecting flange, thereby enabling the cylinder to be manufactured by means of diecasting.

The cover advantageously has a connection for the air duct on the side facing away from the connecting flange. This means that a small cover can be achieved. In order to achieve a good division of the air between the two branches while at the same time minimizing flow resistance, the flow divider is positioned on the flange plane in the projection surface of the air duct connection. In this area the airflow hits the flange plane and is divided by the flow divider upon impact.

In the invention the air duct connection is offset in the direction of the longitudinal cylinder axis towards the combustion chamber in relation to at least one, and in particular both, air openings. As a result there is also a height offset between the air duct connection and the air openings in the cover. In this arrangement, the air connection is positioned in particular in such a manner as to form short flow paths to components ahead of it. The positioning of the cover can be achieved simply by making the flow divider form a guide for the cover. The flange plane expediently forms a wall section of the air duct. The air duct runs roughly parallel to the flange plane in the area of the height offset, part of the air duct wall being formed by the cover and part by the flange plane. This produces a cylinder and cover which are simple to manufacture. At the same time, the parallel course of the air duct and the flange plane produce a short cover with sufficiently large flow cross-sections. A reduction in flow resistance due to the diversion of the air can be achieved if the connecting flange has an indentation which forms a wall section of the air duct.

The intake duct at the connecting flange expediently runs into an intake opening which is overlapped by the cover. In this arrangement, the cover has a connection for the intake duct in particular on the side facing away from the connecting flange. The connections for the air duct and the intake duct are therefore both formed in the cover. This makes it possible to reduce the number of components required for the two-cycle engine and simplifies assembly. A useful design, in particular in terms of an upstream carburetor, results when the air duct connection and the intake duct connection are oriented roughly in the direction of the longitudinal cylinder axis in relation to one another in the cover, the air duct connection being positioned on the side of the intake duct connection facing the combustion chamber. This means that the air duct and its two branches can be of symmetrical design. The air openings are expediently positioned in the direction of the circumference of the cylinder on both sides of the intake opening. In this arrangement, the lower edge of the air openings is expediently offset in the direction of the crankcase in relation to the upper edge of the intake opening. In this arrangement, the ducts run in particular roughly parallel in the cylinder such that the sliders required need pull in only one direction where manufacture is by means of diecasting. This arrangement means that the inlet for fuel into the crankcase and the air duct cut-out intersect in the direction of the longitudinal cylinder axis. This means that it is possible to achieve a short design of the cylinder.

In this invention the cover has at least one shoulder which projects into an opening in the connecting flange and reduces the flow diameter of this opening. This means that it is possible to design a channel with a largely constant flow cross-section in the connecting flange. In this arrangement, it remains possible to manufacture the cylinder by means of diecasting since the channel formed in the cylinder can be designed with narrowed walls. Simple assembly is achieved by screwing the cover to the cylinder. A high degree of leakproofness of the connection coupled with a low weight can be achieved by connecting the cover to the cylinder by welding, soldering or bonding. A compact design of the two-cycle engine with low exhaust emission vales can be achieved by connecting each branch of the air duct to at least one overflow or transfer channel via a piston cut-out or window in predetermined piston positions. The transfer channels are completely scavenged with fuel-free air from the air duct via the piston window. The height offset in the cover allows optimum positioning of the air duct and the intake duct. It also permits manufacture by means of diecasting with few sliders.

BRIEF DESCRIPTION OF THE DRAWINGS

Embodiments of the invention are detailed below with reference to the drawings, in which.

DESCRIPTION OF SPECIFIC EMBODIMENTS

Figure 1:
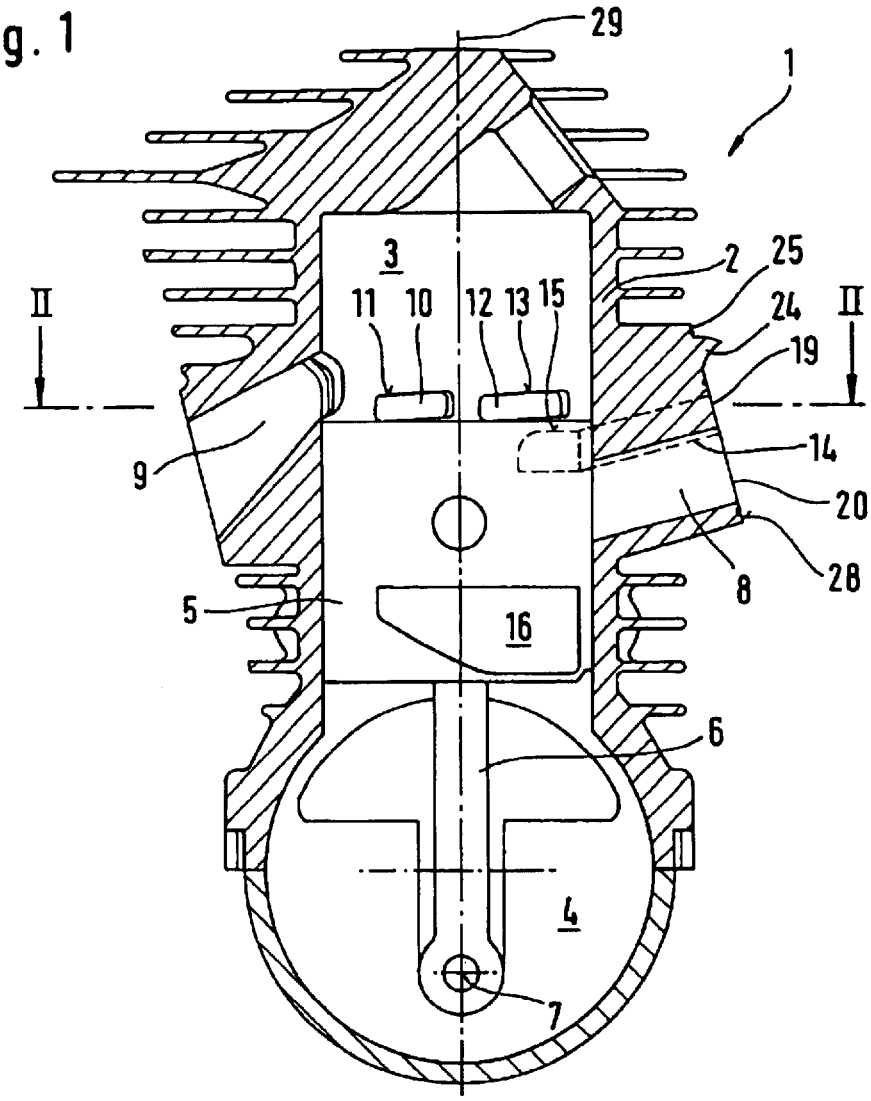
FIG. 1 shows a longitudinal section through a two-cycle engine in the direction of the line marked I—I in FIG. 2.
Figure 2:
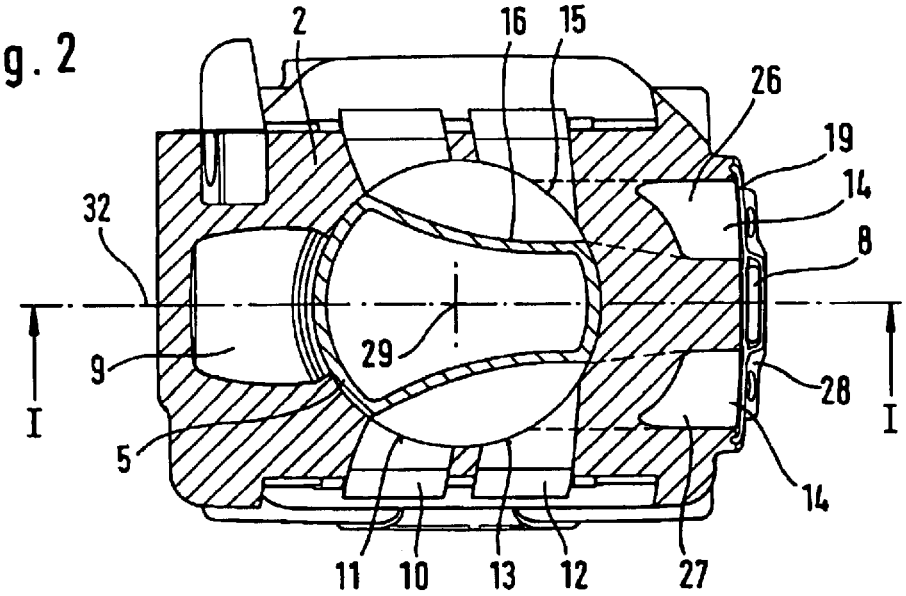
FIG. 2 shows a section through a two-cycle engine in the direction of the line marked II—II in FIG. 1.
Figure 3:
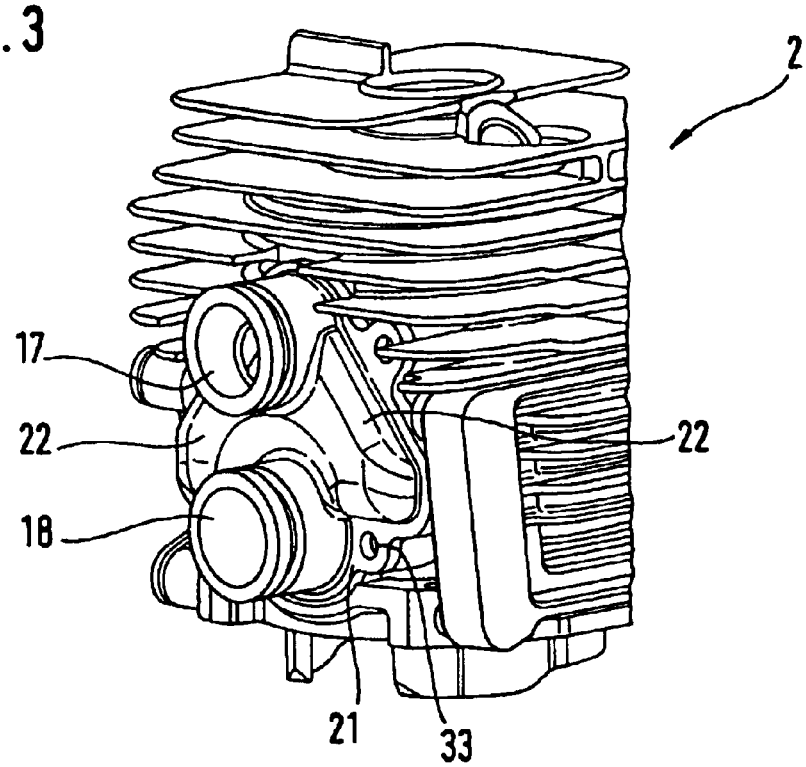
FIG. 3 shows a perspective view of the cylinder of a two-cycle engine with a cover positioned upon it.

The two-cycle engine 1 illustrated in FIGS. 1 and 2 has a cylinder 2 in which is formed a combustion chamber 3. The combustion chamber 3 is bounded by a reciprocating piston 5 which drives the crankshaft 7 mounted in the crankcase 4 via the connecting rod 6. Leading out of the combustion chamber 3 is an outlet 9 for exhaust emissions. In predetermined piston positions such as the piston position illustrated in FIG. 1, for example, the crankcase 4 is connected via the transfer channels 10 and 12 to the combustion chamber 3. In this arrangement, the transfer channel 10 near the outlet runs into the combustion chamber 3 via a transfer cut-out or window 11 and the transfer channel 12 further away from the outlet runs into the combustion chamber 3 via a transfer cut-out or window 13. The cylinder 2 has a central plane 32 which divides the outlet 9 roughly in the center and includes the longitudinal cylinder axis 29. A transfer channel 10 and a transfer channel 12, designed to be symmetrical with one another in relation to the central plane 32, are positioned on either side of the central plane 32. Into the crankcase 4 in the area of the top dead center (TDC) of the piston 5 runs an intake duct 8 for the supply of fuel which generally carries a fuel/air mixture which can be prepared in a carburetor, for example. However, the fuel may also be fed to the crankcase 4 in another form, for example in droplets. In addition, there is also an air duct 14 which is divided in the area of the cylinder 2 into the two branches 26 and 27 which run symmetrically to the central plane 32 on each side of the central plane 32. The branches 26 and 27 of the air duct 14 each run into an air duct cut-out or window 15 in the cylinder 2. The air duct windows 15 are positioned such that they are closed in relation to both the combustion chamber 3 and the crankcase 4 whatever the position of the piston 5. Formed in the piston, which is illustrated in the area of top dead center (TDC) in FIG. 2, are two piston cut-outs or windows 16 symmetrical to the central plane 32. The branches 26 and 27 of the air duct 14 are connected to the transfer channels 10 and 12 on the two sides of the central plane 32 via the piston windows 16.

When the internal combustion is in operation, fuel or fuel/air mixture flows through the intake duct 8 into the crankcase 4 in the area of top dead center (TDC) of the piston 5. At the same time, largely fuel-free air flows through the air duct 14 via the piston window 16 into the transfer channels 10 and 12. As the piston 5 moves downwards, the fuel/air mixture is compressed in the crankcase 4. As soon as the piston 5 opens the outlet 9 exhaust emissions are able to flow out of the combustion chamber 3 through the outlet 9. As soon as the piston 5 opens the transfer windows 11 and 13, largely fuel-free air flows out of the transfer channels 10 and 12 through the transfer windows 11 and 13 into the combustion chamber. The largely fuel-free air from the transfer channels 10 and 12 compresses the exhaust emissions out of the combustion chamber 3. Fuel/air mixture then flows out of the crankcase 4 into the combustion chamber 3. Due to the forward stored air in the transfer channels it is largely possible to avoid scavenging losses. As the piston 5 continues to move upwards, the fuel/air mixture in the combustion chamber 3 is compressed and ignited by a spark plug (not illustrated) in the area of top dead center (TDC).

The air duct 14 runs into a connecting flange 25 at the cylinder 2. The connecting flange 25 is flat in design and inclined in relation to the longitudinal cylinder axis 29 at an angle which opens in the direction of the crankcase 4. Formed at the connecting flange 25 is a flow divider 24 (not illustrated in FIG. 2) whose function is described below. The flow divider 24 extends beyond the flange plane 28. At the connecting flange 25 the intake duct 8 runs into an intake opening 20. The branches 26 and 27 run approximately parallel to the intake duct 8 in the wall of the cylinder 2 which can therefore be manufactured by means of diecasting with one single drawing direction for the cores. In this arrangement, the air openings 14 are positioned on either side of the intake opening 20. At the same time the air openings 19 are positioned offset in the direction of the combustion chamber 3 in relation to the intake opening 20.

In order to supply the intake duct 8 with fuel or fuel/air mixture and to supply the air duct 14, a cover 21 is provided on which are formed an air duct connection 17 and an intake duct connection 18. The cover 21 has mounting openings 33 by which it can be screwed to the cylinder 2. The air duct connection 17 is positioned offset in the direction of the longitudinal cylinder axis 29 in relation to the intake duct connection 18, the air duct connection 17 and the intake duct connection 18 being oriented in the direction of the longitudinal cylinder axis 29. From the air duct connection 17 two air duct sections 22 lead to the air openings 19 at the connecting flange. The air duct sections 22 are bounded on the side facing away from the cylinder 2 by the cover. On the opposite side the air duct sections 22 are bounded by the connecting flange 25. The air duct sections 22 therefore run parallel to the connecting flange plane 28.

Figure 4:
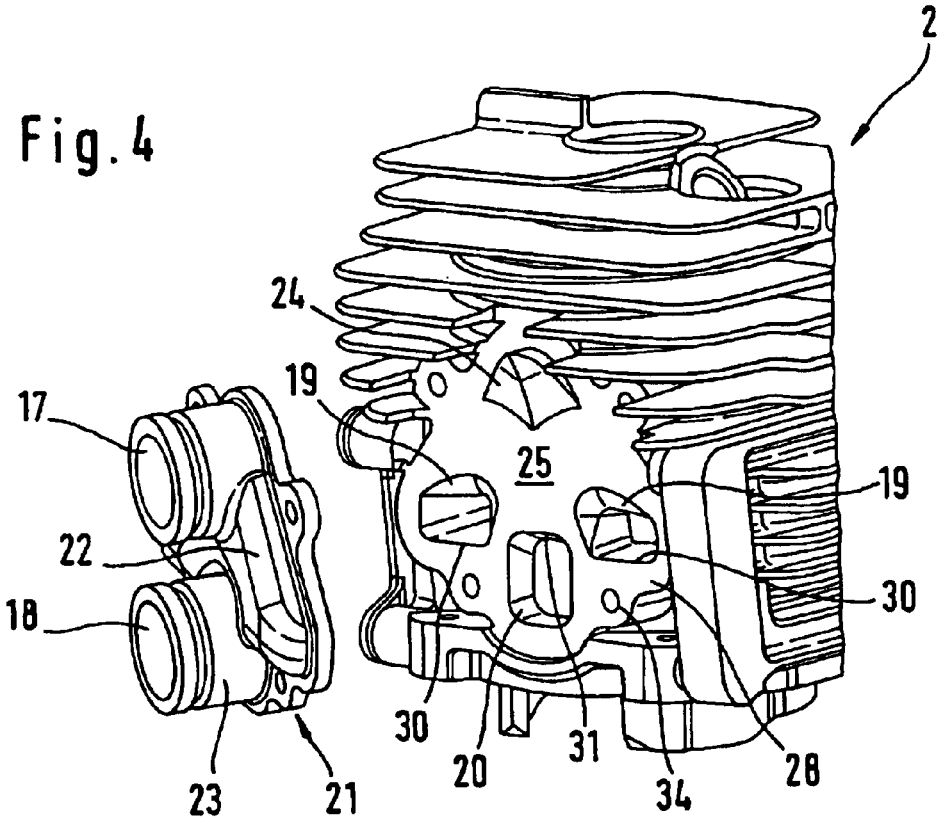
FIG. 4 shows an exploded view of the cylinder illustrated in FIG. 3.

As illustrated in FIG. 4, the air openings 19 are positioned on either side of the intake opening 20. In this arrangement, the lower edges 30 of the air openings 19 are positioned offset in the direction of the combustion chamber 3 in relation to the upper edge 31 of the intake opening 20 such that the intake openings and the air openings intersect in the direction of the circumference. The two air openings 19 together with the flow divider 24 form corner points of an isosceles triangle. The connecting flange 25 has four holes 34 at which the cover 21 can be screwed to the connecting flange 25. A different number of holes, in particular three holes, may however also be advantageous.

Figure 5:
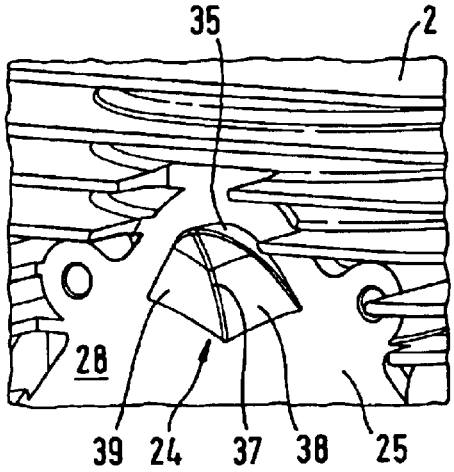
FIG. 5 shows an enlarged perspective view of the flow divider.

FIG. 5 shows an enlarged view of the flow divider 24. The flow divider 24 has a roof 35 which points towards the combustion chamber 3 and on which is guided the cover 21 at the guide surface 36 illustrated in FIG. 7. The roof 35 is curved and therefore lies adjacent to the guide surface 36. The flow divider 24 has an edge 37 which serves to divide the flow. The edge 37 rises up from the flange plane 28 approximately in the direction of the longitudinal cylinder axis 29, the distance of the edge 37 being greatest at the roof 35 and decreasing towards the crankcase 4. On both sides of the edge 37 the flow divider 24 has inclines (38 and 39) which have concave surfaces and which meet at the edge 37. The sides of the inclines (38 and 39) facing away from the edge 37 are bounded by the curved roof 35.

Figure 6:
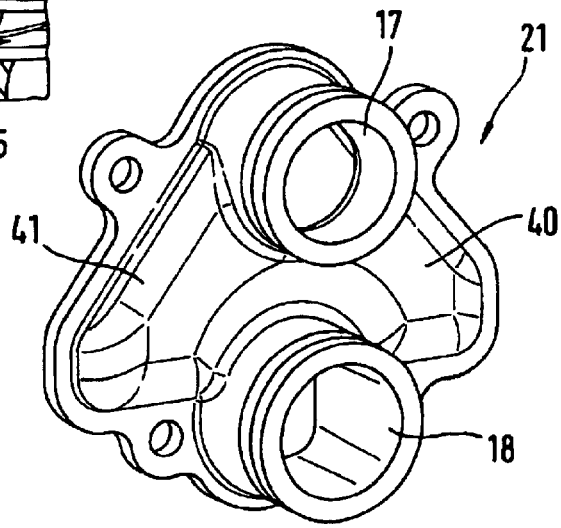
FIG. 6.
Figure 7:
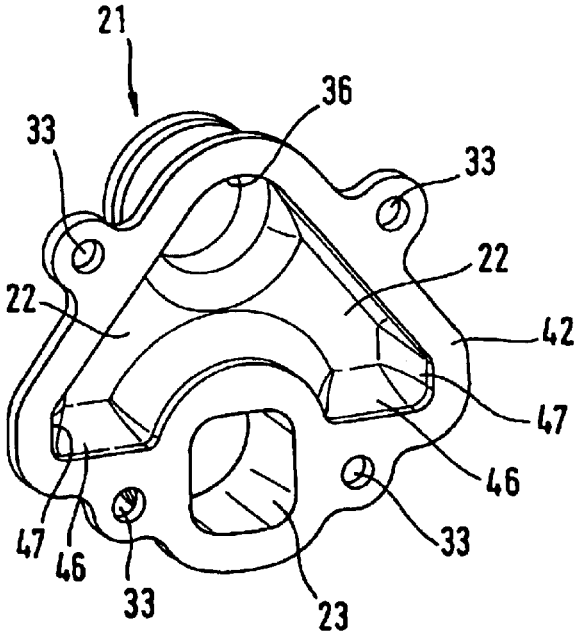
FIG. 7 show perspective views of the cover.

FIGS. 6 and 7 show an enlarged view of the cover 21. Formed in the cover 21 is the intake duct section 23 which runs roughly in a straight line and, when mounted to the flange, roughly perpendicular in relation to the flange plane 28. The air duct sections 22 are bounded by walls 40 and 41 of the cover 21 which run parallel to the flange plane 28 a certain distance apart. The cover 21 has a peripheral sealing edge 42 in which are formed the four mounting openings 33. The sealing edge 42 also separates the air duct sections 22 from the intake duct section 23.

Figure 8:
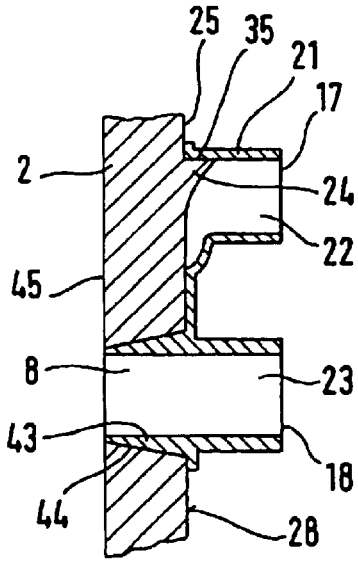
FIG. 8 shows a partial section of a cylinder flange with a cover placed upon it.

FIG. 8 shows an embodiment of a cover 21. The section of the intake duct 8 formed in the cylinder 2 has side walls 44 which are inclined so that the intake duct 8 becomes narrower towards the interior of the cylinder. This facilitates the removal of the cylinder 2 from its mold during the diecasting manufacturing process. In order to achieve an approximately constant flow cross-section in the air duct 8, the cover 21 has a shoulder 43 which extends from the intake duct connection 18 in the form of a tube beyond the flange plane 28 into the cylinder 2. In this arrangement, the shoulder 43 may extend as far as the cylinder bore 45. It may however be useful for the shoulder 43 to end at a distance from the cylinder bore 45. Corresponding shoulders can be also be formed on the walls 46 and 47 of the cover 21 which are illustrated in FIG. 7. In this arrangement, the walls 46 and 47 are the walls of the cover 21 which run parallel to side walls at the air openings 19. The projection of the shoulder 43 into the intake duct 8 can also lead to a better seal between the cover 21 and the cylinder 2. The cover 21 illustrated in FIG. 8 is mounted on the roof 35 of the flow divider 24.

Rather than screwing the cover to the cylinder, it can also be connected by means of welding, soldering, bonding or any other appropriate connecting process. This helps to achieve a low weight and a degree of high leakproofness for the connection.

Figure 9:
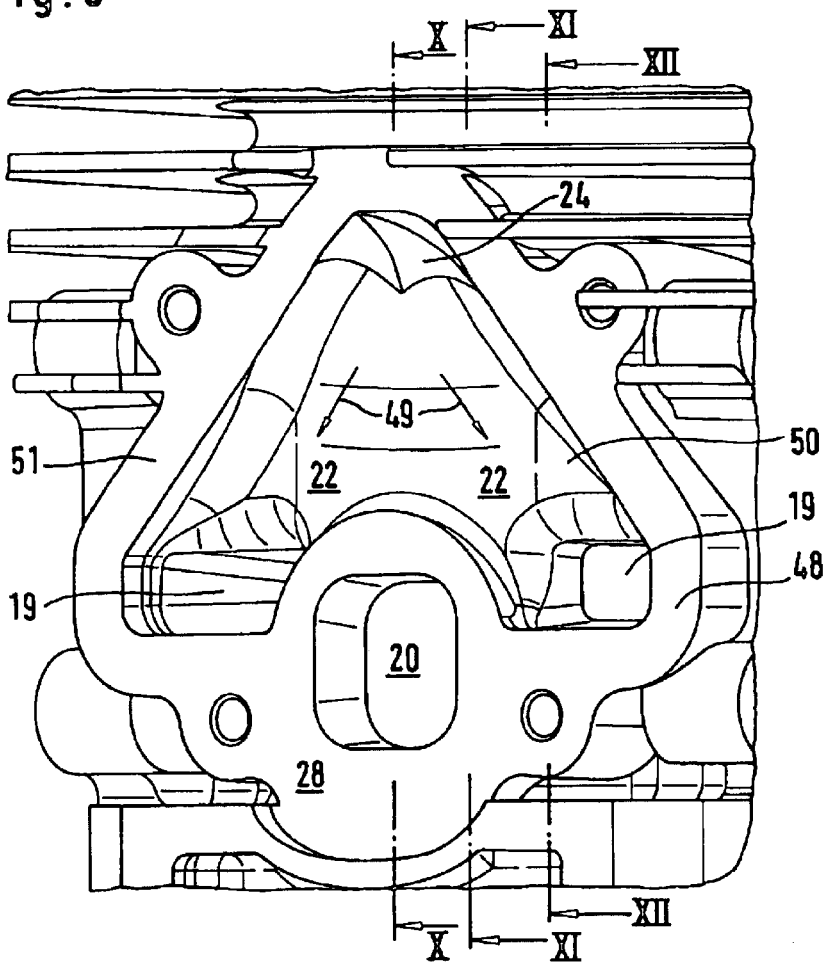
FIG. 9 shows a perspective view of the connecting flange.

FIG. 9 shows a connecting flange 48 which has a flat, peripheral edge 51. The edge 51 encloses the wall 50 which forms a wall of the air duct sections 22. The wall 50 is offset in the direction of the inside of the cylinder in relation to the flange plane 28 and thus forms an indentation in the flange plane 28.

Figure 10:
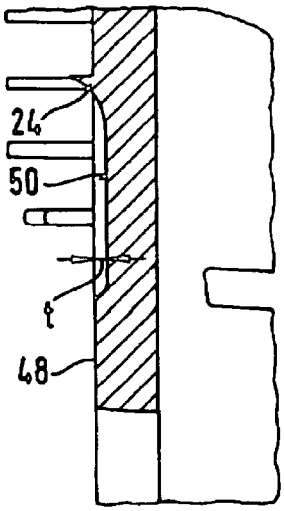
FIG. 10 shows a view of the section along the line marked X—X in FIG. 9.
Figure 11:
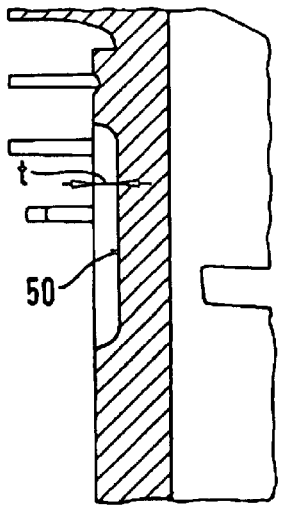
FIG. 11 shows a view of the section along the line marked XI—XI in FIG. 9.
Figure 12:
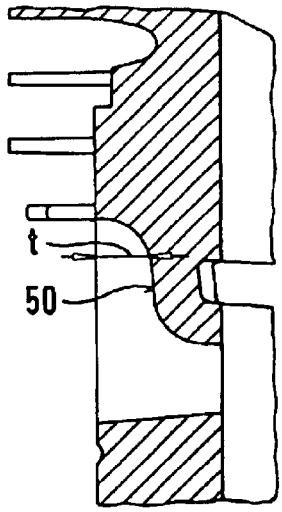
FIG. 12 shows a view of the section along the line marked XII—XII in FIG. 9.

FIGS. 10 to 12 show sections through the connecting flange 48 in various planes, the cutting plane being illustrated by hatching. The depth (t) of the indentation measured perpendicular to the flange plane 28 increases in the direction of flow 49. If the air duct meets the flange plane 28 perpendicularly the air is diverted by less than 90°. This reduces flow losses. The flow divider 24 projects out of the flange plane 28 and runs up to the wall 50. The reference numerals used here designate the same components as in the previous figures.

The specification incorporates by reference the disclosure of German priority document 103 12 096.3 filed Mar. 19, 2003.

The present invention is, of course, in no way restricted to the specific disclosure of the specification and drawings, but also encompasses any modifications within the scope of the appended claims.

We claim:

1. A two-cycle engine, comprising:

a cylinder in which is formed a combustion chamber that is delimited by a reciprocating piston that via a connecting rod drives a crankshaft that is rotatably mounted in a crankshaft, wherein in predetermined positions of said piston said crankcase communicates with said combustion chamber via transfer channels wherein said cylinder has an outlet leading out of said combustion chamber, wherein an intake duct leads into said crankcase for a supply of fuel, wherein an air duct is provided for a supply of substantially fuel-free air, and wherein said air duct, in the vicinity of said cylinder, is divided into two branches;

a connecting flange formed on said cylinder, wherein said two branches of said air duct open out at air openings of said connecting flange;

a cover disposed on said connecting flange, wherein said cover extends over said air openings; and a flow divider disposed or formed on said connecting flange, wherein said flow divider projects beyond a plane of said connecting flange and into said cover, and wherein said flow divider divides an air flow in said air duct to said two branches.

2. A two-cycle engine according to claim 1, wherein said cover, on a side facing away from said connecting flange, is provided with a connection for said air duct.

3. A two-cycle engine according to claim 2, wherein said flow divider is disposed in a projection surface of said air duct connection toward said plane of said connecting flange.

4. A two-cycle engine according to claim 2, wherein said air duct connection is offset toward said combustion chamber relative to at least one of said air openings in a direction of a longitudinal axis of said cylinder.

5. A two-cycle engine according to claim 4, wherein said air duct connection is offset relative to both of said air openings of said connecting flange.

6. A two-cycle engine according to claim 1, wherein said flow divider forms a guide for said cover.

7. A two-cycle engine according to claim 1, wherein said plane of said connecting flange forms a wall portion of said air duct.

8. A two-cycle engine according to claim 1, wherein said connecting flange has a recess that forms a wall portion of said air duct.

9. A two-cycle engine according to claim 2, wherein said intake duct opens out at said connecting flange at an intake opening over which extends said cover, and wherein on a side that faces away from said connecting flange said cover is provided with a connection for said intake duct.

10. A two-cycle engine according to claim 9, wherein said air duct connection and said intake duct connection are oriented relative to one another in said cover approximately in a direction toward a longitudinal axis of said cylinder, and wherein said air duct connection is disposed on a side of said intake duct connection that faces said combustion chamber.

11. A two-cycle engine according to claim 9, wherein when viewed in a circumferential direction of said cylinder, said air openings are disposed on opposite sides of said intake openings of said intake duct.

12. A two-cycle engine according to claim 9, wherein a lower edge of said air openings on said connecting flange are offset relative to an upper edge of said intake opening in a direction toward said crankcase.

13. A two-cycle engine according to claim 1, wherein said cover is provided with at least one shoulder that projects into an opening in said connecting flange.

14. A two-cycle engine according to claim 1, wherein said cover is screwed onto said connecting flange of said cylinder, or is connected to said connecting flange via welding, soldering, or bonding.

15. A two-cycle engine according to claim 1, wherein in predetermined positions of said piston, each of said branches of said air duct is connected via a piston window with at least one of said transfer channels.

* * * * *